United States Patent [19]

Troetscher

[11] Patent Number: 4,890,394

[45] Date of Patent: Jan. 2, 1990

[54] METHOD AND APPARATUS FOR DRYING FLAT STRUCTURAL COMPONENTS

[75] Inventor: Gerhard Troetscher, Lindau, Fed. Rep. of Germany

[73] Assignee: Lindauer Dornier Gesellschaft m.b.H., Lindau, Fed. Rep. of Germany

[21] Appl. No.: 258,580

[22] Filed: Oct. 17, 1988

[30] Foreign Application Priority Data

Oct. 17, 1987 [DE] Fed. Rep. of Germany ..... 3735242

[51] Int. Cl.[4] ..... F26B 3/34

[52] U.S. Cl. ..... 34/1; 34/17; 34/60; 34/210

[58] Field of Search ..... 34/1, 17, 18, 60, 209, 34/210, 52, 205

[56] References Cited

U.S. PATENT DOCUMENTS 2,408,434 10/1946 Mann et al. ..... 34/1
2,543,618 2/1951 Wood ..... 34/1
3,435,535 4/1969 Blair ..... 34/205 X
3,548,513 12/1970 Taylor ..... 34/205
3,775,860 12/1973 Barnes et al. ..... 34/1
4,204,337 5/1980 Roos et al. ..... 34/52 X

*Primary Examiner*—Henry A. Bennet
*Assistant Examiner*—John Sollecito
*Attorney, Agent, or Firm*—W. G. Fasse; D. H. Kane, Jr.

[57] ABSTRACT

Flat structural components such as sheetrock panels are dried sequentially by two different drying methods and devices. The first drying is performed as a convection drying, whereby surface layers of the panels are dried. The second drying is performed by a high frequency drying, whereby a still moist central core layer is dried down to a desired remainder moisture content. During the second drying by a high frequency generator, the moisture is driven out by diffusion, whereby any over-drying of outer surface layers is reversed again so that any over-drying, or rather damages that may be caused by dehydration of the gypsum in the sheetrock panels is repaired again since the outwardly diffusion moisture enables the gypsum to cure and set again.

11 Claims, 4 Drawing Sheets

METHOD AND APPARATUS FOR DRYING FLAT STRUCTURAL COMPONENTS

FIELD OF THE INVENTION

The invention relates to a method and drier for drying flat structural components such as fiber reinforced sheetrock panels or chip reinforced sheetrock panels. In such driers the panels are transported on a conveyor through the drier, whereby the moisture in the panels is removed by application of heat.

BACKGROUND INFORMATION

Such drying plants for structural panels are known in the form of convection driers. The panels to be dried pass on a conveyor belt sequentially into the convection drier, wherein the panels are exposed to heated air on both surfaces of the panel. The air temperature may change from the drier input end to its output end. These temperatures are within the range of about 80° C. to about 240° C., whereby the undesirable water content of the panels is removed by these relatively high air temperatures.

Depending on the thickness of the panels, and on other physical conditions, such as the temperature of the drier, the air speed, and so forth, the required drying times may be within the range of a few minutes up to an hour and more, especially where thicker panels are involved. Where the panel thickness exceeds 30 mm, the drying times become disadvantageously long. For example, fiber or chip reinforced sheetrock having a thickness of 38 mm requires a drying time of up to 6 hours and more. Thus, assuming an hourly throughput rate of 130 $m^2$ of panel surface, a four tier drier would be required, having a length between 80 and 90 m. Such a drier requires substantial capital investments, not only for the drier itself, but also for the building to house the drier. Another disadvantage of prolonged drying times with the panel material exposed to higher air temperatures, is the fact that especially the surface of the panel may be damaged, for example, due to dehydrating the gypsum.

There are also high frequency driers available in the art for drying by water withdrawal. These driers have so far been used in the paper production for a preliminary drying of paper and cardboard products. Such high frequency driers have also been used for a complete drying of such products, whereby however a substantial power input is required per volume of paper product dried. As a result, such high frequency driers have not been very economical as far as their operating costs are concerned. Another disadvantage of high frequency driers or ovens has been in the past that the vapor exit could damage the product, especially if the product had larger thicknesses. In addition, or instead of the vapor exit damage, bubble formation was a problem due to the internally produced heat of the material to be dried. Even minor damages in limited areas are undesirable. For these reasons, high frequency driers have so far not been used for drying flat structural components, such as sheetrock. Rather, such high frequency driers have been used for thin thickness products, especially paper or the like.

OBJECTS OF THE INVENTION

In view of the foregoing it is the aim of the invention to achieve the following objects singly or in combination:

to provide a drier which combines the advantages of convection driers and high frequency driers and thereby eliminates their disadvantages, even when used for drying relatively thick structural panels holding a substantial moisture content;

to dry such panels relatively quickly and relatively inexpensively in accordance with the present method;

to use the convection drier in zones of the panel to be dried where the convection drier is most effective and to use the high frequency drier where it is most effective; and to provide a drying operation which will maintain the high quality of the panels to be dried, especially structural components such as sheetrock, fiber reinforced panels, chip boards, and the like.

SUMMARY OF THE INVENTION

According to the invention the above mentioned structural components are dried in a two step sequence, whereby a preliminary drying is performed with a convection drier and a finish drying is performed by a high frequency drier arranged downstream of the convection drier as viewed in the travel direction of the structural components. In this type of arrangement the convection drier dries zones of the flat products which are relatively close to the surface of the product while the high frequency drier dries a central core zone.

According to the invention the initially performed convection drying becomes effective from the surface of the panels inwardly, whereby the convection heating is stopped in time to prevent any damage to the panels being dried. Thus, the panels retain a certain remainder moisture at the end of the convection drying. The completion of the required drying is then performed by the high frequency method again until a certain desired remainder moisture is reached, whereby this high frequency drying takes place from the inside out, rather than from the outside in. It has been found that the travelling of the moisture from the inside out through the previously dried surface zones is beneficial since it prevents damage to the outside layers. The benefit is apparently due to the fact that the moisture travelling from the inside out remoistens the surface layers sufficiently to prevent damage, especially in thick sheetrock panels. This travel of the moisture from the inside out renews the curing or setting of the gypsum matrix material and assures the undisturbed completion of the curing.

Due to the removal of moisture in the surface zones or layers of the panels by the convection heating, these surface zones are easily dehydrated, whereby a certain destabilization of the surface layers occurs. Such destabilization makes the surface layers somewhat chalk-like, whereby the material strength of the panel may be impaired. The invention avoids this problem inherent in conventional convection driers. These problems are avoided by the invention because the high frequency drying causes moisture from the internal central zone of the panel to travel outwardly by diffusion. Thus, water vapor enters into the dehydrated outer layers, thereby causing the above mentioned beneficial effect of a continuous setting of the gypsum matrix. As a result, the invention achieves a more rapid and hence a relatively more inexpensive drying in combination with a renewed strengthening of the surface layer zones. Accordingly, panels dried according to the invention have an increased mechanical strength as compared to conventionally dried panels of the same dimension and the same composition.

According to the invention the desired remainder moisture inside the panels is effectively controlled by controlling the power input in one and/or both of the drying stages and/or by changing the throughput speed of the panels. Thus, a constant or uniform remainder moisture is assured in each panel, which is beneficial for obtaining a product of uniform characteristics. In this context is has been found to be beneficial to assure that the panels coming out of the high frequency drier still contain a certain small remainder moisture which contributes to a stabilized and uniform curing of the gypsum matrix.

The convection heating zone is preferably constructed according to the invention in the form of a multi-tier drier, wherein each panel is exposed to hot air nozzles on its upwardly and on its downwardly facing surfaces, and wherein the entire drier has in series arranged zones of which the entrance zone has the highest temperature while the exit zone has the lowest temperature so that the temperature decreases from the input to the output. This arrangement permits a rapid drying since the preliminary drying now can take place at increased temperatures as compared to conventionally operated convection driers. This is possible due to the remoistening of the outer surface zones by the subsequent high frequency drying which dries remaining moisture from a central core zone or layer outwardly.

The high frequency generator according to the invention comprises preferably a first zone with an inlet sluice, an intermediate transfer zone leading from the first zone into a second high frequency drying zone provided with an outlet sluice. The inlet and outlet sluice makes sure that high frequency energy is prevented from radiating outside of the high frequency drier. By dividing the high frequency oven into two zones each having its own high frequency generator, it is possible to use less expensive and simpler high frequency generators.

It has been found that the transport belt through the high frequency oven or ovens should be made of glass fibers since such a transport belt does not affect the high frequency characteristics of the high frequency drier oven so that the generated energy is applied substantially exclusively to the panels passing through the high frequency drier.

BRIEF DESCRIPTION OF THE DRAWINGS

In order that the invention may be clearly understood, it will now be described, by way of example, with reference to the accompanying drawings, wherein:

FIG. 4a is a view similar to that of FIG. 4, but showing on an enlarged scale the conveyor of the top tier in FIG. 4, the lower portion of FIG. 4 being omitted in FIG. 4a;

DETAILED DESCRIPTION OF PREFERRED EXAMPLE EMBODIMENTS AND OF THE BEST MODE OF THE INVENTION

Figure 1:
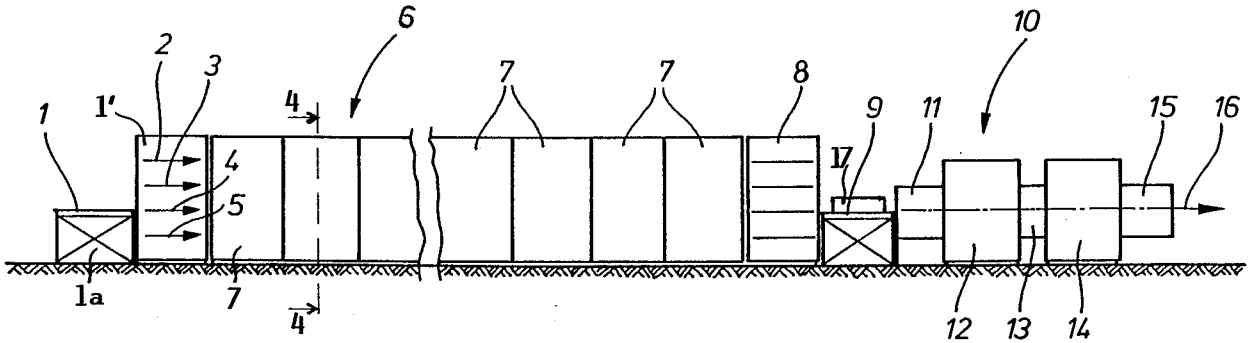
FIG. 1 is a schematic side view of a drier according to the invention combining a convection drier with a high frequency drier.

FIG. 1 illustrates two main sections of a drier according to the invention, namely a convection drier section 6 and a high frequency drier section 10. The convection drier section 6 comprises an inlet unit 1', a plurality of intermediate units 7, and an outlet unit 8. The high frequency drier section 10 comprises an inlet sluice 11, a first high frequency generator unit 12, a transit section 13, a second high frequency generator section 14, and an exit sluice 15.

Panels 1 to be dried are supplied to an infeed table 1a for placement onto any one of, for example, four transport conveyors 2, 3, 4, and 5 only symbolically shown by arrows in FIG. 1. The construction of these transport conveyors having endless air permeable conveyor belts is conventional as is the arrangement o, for example, four tiers of such conveyors passing through all the drier units. A transfer table 9 is arranged between the outlet unit 8 of the convection drier and the inlet sluice 11 of the high frequency drier. A conveyor 16 is also symbolically indicated as passing through the high frequency drier section 10. The speeds of the multi-tier conveyors 2, 3, 4, and 5 will be adjusted relative to the desired drying and relative to the speed of the conveyor 16, the latter will normally run substantially faster than the conveyor 2, 3, 4 and 5, for example four times faster to make sure that the partially dried panels supplied by the convection drier section 6 will not unduly accumulate on the intermediate transfer section or table 9.

According to the invention it is critical that the convection drier section 6 is arranged upstream of the high frequency drier section 10 as viewed in the feed advance direction of the panels 1 as will be explained in more detail below. Each panel 1 receives hot air on its upwardly facing surface and on its downwardly facing surface, whereby the air temperature in the inlet unit 1' is, for example, 240° C., while the air temperature in the outlet unit 8 is only about 80° C. so that the panels exiting onto the transfer table 9 have a temperature of about 80° as a result of the cooling effect caused by the temperature decrease from the inlet to the outlet of the convection drier section 6.

The number of convection drier units 7 will depend on the required throughput. A total of ten units, including the inlet and outlet units 1' and 8 respectively, is practical. The mechanical feeding of panels onto the conveyors in the inlet unit 1' and the mechanical removal of partially dried panels from the outlet unit 8 can be accomplished by conventional, mechanized automatically operating equipment for handling flat structural panels such as sheetrock, wall panels, wallboards, and the like. Such equipment may also be used at the output end of the high frequency drier section 10, where the dried panels emerge at 16.

Figure 2:
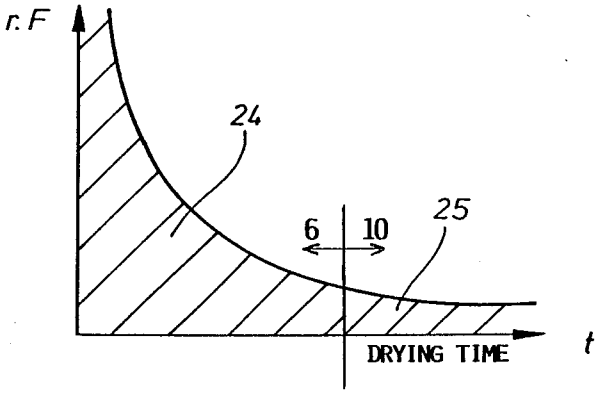
FIG. 2 is a drying diagram in which the moisture content of a panel is shown as a curve or function of the drying time.

FIG. 2 shows the moisture content as a function of drying time, specifically the moisture content of a panel from the beginning of the drying at the left hand end of FIG. 1 to the end of the drying at the outlet end of FIG. 1 at 16. At the beginning the moisture content is quite high and the convection drier section 6 removes the moisture in the zone 24 while the high frequency drier 10 removes moisture in the zone 25. For example, when a charge of panels comprises a total water content of about 900 kg, 800 kg of that total amount will be removed in the convection drier 6, while a portion of the remaining moisture content will be removed by the high frequency drier section 10. A certain amount of remainder moisture is retained even after the completion of the drying in order to prevent warping of the dried panels. Thus, of the remaining 100 kg only about 3 to 4% are removed by the high frequency oven 10.

Figure 3:
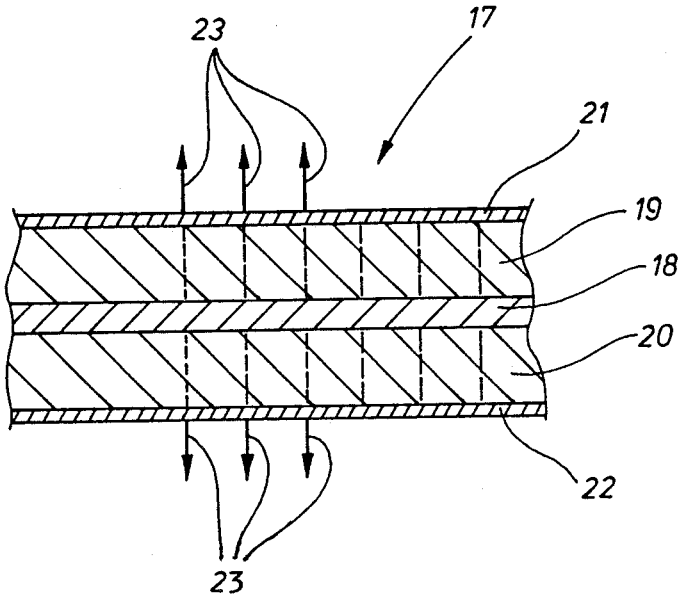
FIG. 3 is a sectional view through a panel dried according to the invention.

Heretofore, high frequency driers have not been used for drying flat structural components, especially relatively thick panels such as sheetrock panels. Presumably, it was assumed that such drying down to a very low remainder moisture content would cause cracks in sheetrock panels. The operation of the drying according to the invention will now be explained with reference to FIG. 3, showing a sectional view through a partially dried sheetrock panel 17 as it appears at the discharge station 8 or on the transfer section or table 9. The partially dried panel 17 has still a moist core 18 and on each side of the core 18 partially predried zones 19 and 20. It has been found to be unfavorable that a panel exiting from the convection drier section 6 has dehydrated surface layers 21 and 22. This is due to the fact that the convection drying heated air dehydrates the surface layers 21 and 22 by removing hydration water from the sheetrock panel 17. As a result of this dehydration, these top surface layers become, to some extent, destabilized, which may be noted by the chalky appearance. Such surface layer zones impair the mechanical strength of the panel. Heretofore, it was not possible to avoid these dehydrated surface layer zones when the sheetrock panels were dried in a convection drier only.

The invention avoids the above problem by using the high frequency drier section 10 downstream of the convection drier section 6. The high frequency drying assures that the moist core 18 is dried relatively quickly, whereby the moisture passes from the center outwardly as indicated by the arrows 23 and 24. The moisture travels by diffusion and on its way out must pass through the dehydrated layers 21 and 22. As a result, the layers 21 and 22 are moistened again, thereby hydrating the gypsum resulting in a renewed curing or setting of the gypsum and strengthening the outer layers, 21, 22. As a result, the invention achieves superior panels by the combination of two types of heating as described, whereby, as mentioned, it is critical that the high frequency drying follows the convection drying. The advantages are not achieved if the high frequency drying precedes the convection drying.

It is important that the power supply to the heaters is controlled so that an upper heat limit is not exceeded, especially the upper limit of the electrical energy for the high frequency generator must not be exceeded. This upper limit for the high frequency generator energy supply is determined on the one hand by the thickness of the panel and on the other hand by the above mentioned three to four percent remainder moisture content. Further, the energy supply control and the feed advance speed of the conveyor 16 through the high frequency heater must be such that the moisture motion from the inside out is by diffusion so that vapor bubbles are avoided. Similarly, the formation of water droplets must be avoided.

Figure 6:
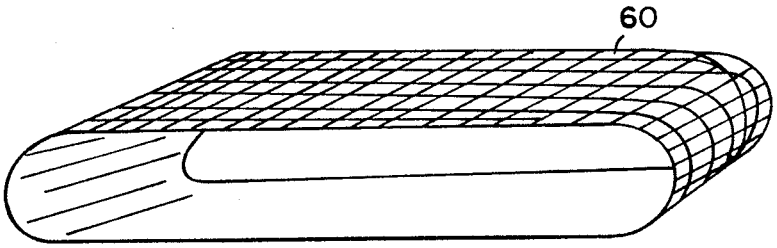
FIG. 6 illustrates schematically a fiberglas conveyor belt for use in the present apparatus, especially in the high frequency drier section.

As shown in FIG. 6, the conveyor belt 60 for the high frequency drier section 10 is preferably made of a fiberglas construction, such as a fiberglass mesh structure. Incidentally, the frequency of the energy generated by the high frequency generators 12 and 14 is preferably about 14 MHz.

As mentioned, the remainder moisture content of 3 to 4% of the panels passing out of the high frequency drier at 16 can be measured by conventional moisture measuring devices and the moisture content may be maintained constant at the time of exit from the drier by different means or the combination thereof, such as the varying of the throughput speed of the conveyor 16 and/or the electrical power input to the high frequency generators 12 and 14.

Figure 4A:
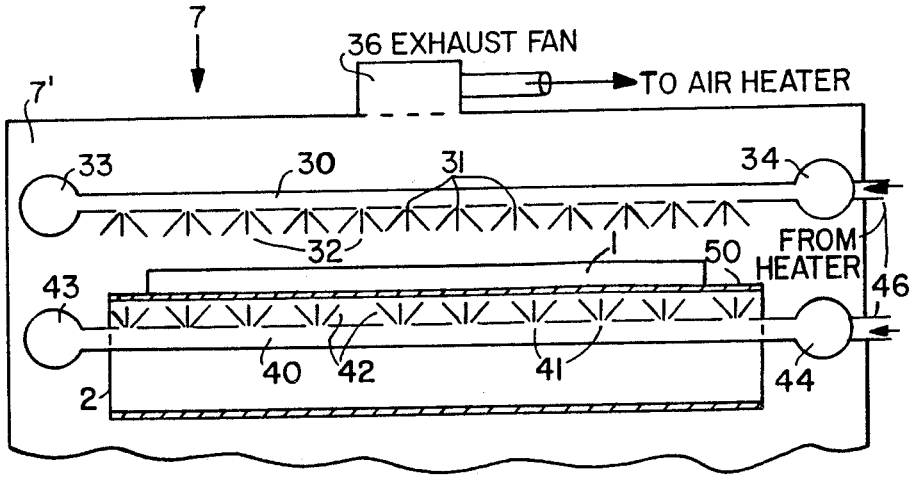
Figure 4:
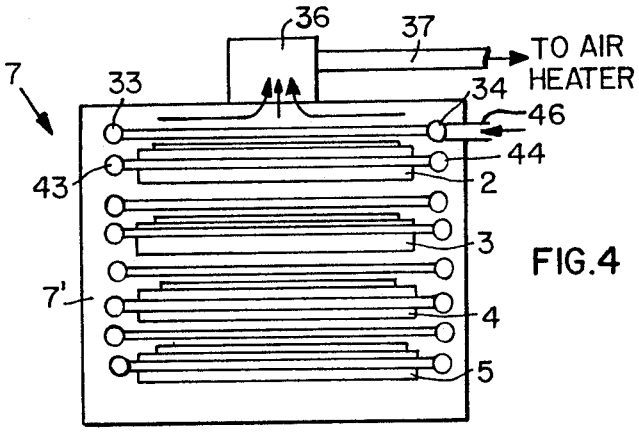
FIG. 4 is a view into a drying unit substantially in the direction of the arrows 4—4 in FIG. 1.

Referring to FIGS. 4 and 4a the convection drier comprises two groups of hot air supply ducts 30 and 40 for each upper run 50 of each conveyor 2, 3, 4, and 5. The ducts 30 have downwardly facing perforations 31 to form downwardly directed drying air jets 32. These air jets 32 direct their drying air onto the upwardly facing surface of a panel 1 on the upper run 50, for example, of the conveyor 2 shown in more detail in FIG. 4a. These conveyor belts have perforations therein so that air jets 42 passing through perforations 41 in the duct 40 can be directed against the downwardly facing surface of the panel 1. Each convection drying unit 7 has a housing 7' which is substantially closed, except for an opening permitting the passage of the panels 1 from one chamber into the other. The conveyors can be constructed so that each unit 7 has its own conveyor, whereby the panels pass from one conveyor to the other from unit to unit. The drying air supply duct 30 is connected to manifolds 33 and 34 which receive hot drying air from an air heater 35 shown in FIG. 5. Similarly, the lower air supply ducts 40 for each conveyor receive hot air through the manifolds 43 and 44 also connected to the air heater 35. An exhaust fan 36 returns used air out of the units 7 to the air heater 35 through duct means 37 which may include cleaners.

Figure 5:
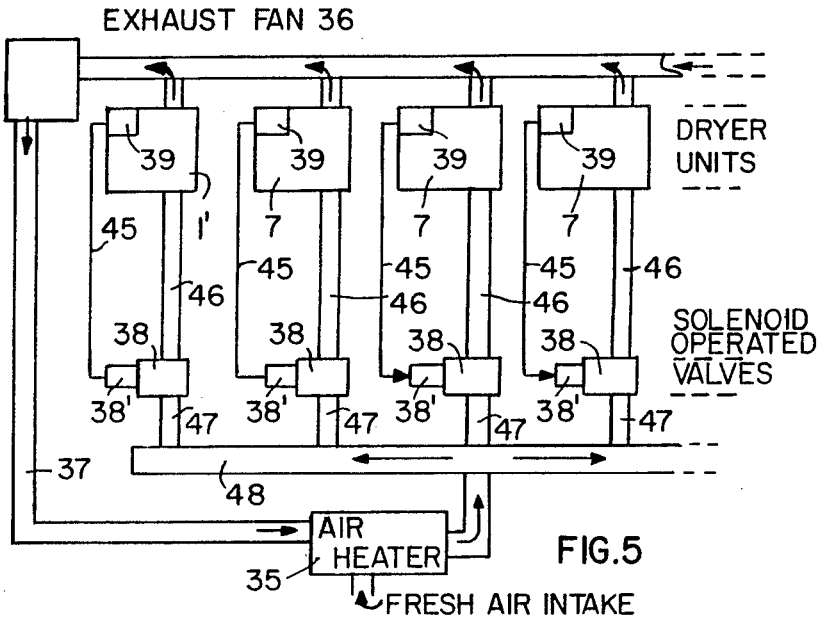
FIG. 5 is a diagrammatic view for a temperature control of the hot air supply into the drying units of the convection heater in FIG. 1.

Referring to FIG. 5, each of the convection drying units 1', 7, 8 has its own thermostat 39 for controlling the supply of fresh hot air into the respective unit through solenoid operated valves 38. These valves 38 are driven by their respective solenoid 38' which receives the electrical signal through an electrical conductor 45 connecting the respective solenoid 38' to the corresponding thermostat 39. The thermostat 39 of the entrance drying unit 1' is so adjusted that the drying temperature in the first unit 1' will be about 240° C. The thermostat of the last unit or exit unit 8 will be adjusted so that the temperature in that unit is about 80° C. The conduits 46 lead from the respective valves to the manifolds 33, 34, 43, and 44. The conduits 47 lead from the valves 38 to a manifold 48 which in turn is connected to the air heater 35.

The control of the heat in the several convection drying units may be accomplished in various ways and FIG. 5 is just one example.

Although the invention has been described with reference to specific example embodiments, it will be appreciated, that it is intended to cover all modifications and equivalents within the scope of the appended claims.

What is claimed is:

1. A drier for drying flat structural components, especially wall boards, comprising convection first drying means for applying convection heat to said flat structural components, said convection first drying means comprising several convection drying stages arranged in sequence between an inlet and an outlet of said convection drying means, and means for controlling the temperature of said convection heat provided by said convection drying stages so that said temperature decreases from said inlet to said outlet, and high frequency second drying means for applying heat internally to said flat structural components after the convection drying.

2. The drier of claim 1, wherein said convection first drying means comprises a multilevel drier including hot air nozzles arranged above and below each level for blowing hot air onto both surfaces of said flat structural components.

3. The drier of claim 1, wherein said high frequency second drying means comprise the following members arranged in series as viewed in a travel direction of said flat structural components, a first sluice arranged at an inlet of said high frequency drying means for preventing the escape of high frequency energy, a first high frequency oven downstream of said first sluice, a linking passage downstream of said first high frequency oven, a second high frequency oven downstream of said linking passage, and a second sluice downstream of said second high frequency oven for preventing the escape of high frequency energy.

4. The drier of claim 3, further comprising conveyor means for passing said structural components through said high frequency drying means.

5. The drier of claim 4, wherein said conveyor means comprise a conveyor belt made of glass fibers.

6. The drier of claim 1, further comprising a transfer station between said first convection drying means and said second high frequency drying means.

7. The drier of claim 2, wherein said multi-level drying means comprise multi-tier conveyor means.

8. A method for drying flat structural components, comprising the following steps:

(a) first convection heating said flat structural components for drying outer surface layers of flat structural components, (b) controlling said convection heating so that heat applied to said flat structural components diminishes from the beginning to the end of said convection heating, and (c) second high frequency heating said flat structural components for drying an inner layer of said flat structural components whereby moisture from said inner layer is driven out through said initially dried outer layers.

9. The method of claim 8, further comprising controlling the supply of heating energy so that a remainder moisture content present in said flat structural components when said high frequency heating is completed, is substantially uniform in all components at the end of a drying cycle.

10. The method of claim 8, further comprising controlling a speed of passing said flat structural components through said first and second heating steps so that a remainder moisture content present in said flat structural components is substantially uniform at the end of a drying cycle.

11. A drier for drying flat structural components, especially wall boards, comprising convection first drying means for applying convection heat to said flat structural components and high frequency second drying means for applying heat internally to said flat structural components after the convection drying, wherein said high frequency second drying means comprise the following members arranged in series as viewed in a travel direction of said flat structural components, a first sluice arranged at an inlet of said high frequency drying means for preventing the escape of high frequency energy, a first high frequency oven downstream of said first sluice, a linking passage downstream of said first high frequency oven, a second high frequency oven downstream of said linking passage, and a second sluice downstream of said second high frequency oven for preventing the escape of high frequency energy.

* * * * *